US005255776A

United States Patent [19]

Grecksch et al.

[11] Patent Number: 5,255,776

[45] Date of Patent: Oct. 26, 1993

[54] SYSTEM FOR INDEPENDENTLY TRANSPORTING DIFFERENTLY SIZED TEXTILE PACKAGES ON INDEPENDENT TUBE SUPPORT MEMBERS HAVING IDENTICAL BASE COMPONENTS

[75] Inventors: Hans Grecksch; Gregor Rüth; Dietmar Englehardt, all of Moenchengladbach, Fed. Rep. of Germany

[73] Assignee: W. Schlafhorst AG & Co., Moenchengladbach, Fed. Rep. of Germany

[21] Appl. No.: 812,723

[22] Filed: Dec. 23, 1991

[30] Foreign Application Priority Data

Dec. 24, 1990 [DE] Fed. Rep. of Germany ..... 4041715

[51] Int. Cl.[5] ..... B65G 29/00

[52] U.S. Cl. ..... 198/465.1; 198/803.12; 242/35.54

[58] Field of Search ..... 198/46.51, 487.1, 803.12, 198/803.01, 465.2, 795; 242/35.5 A

[56] References Cited

U.S. PATENT DOCUMENTS

| | | | |
|---|---|---|---|
| 4,634,066 | 1/1987 | Matsui et al. | 198/405.1 X |
| 4,681,231 | 7/1987 | Ueda et al. | 198/354 |
| 4,718,560 | 1/1988 | Kiriake | 198/465.1 X |
| 4,875,572 | 10/1989 | Kiriake | 198/744 |

*Primary Examiner*—Robert P. Olszewski
*Assistant Examiner*—Cheryl L. Gastineau
*Attorney, Agent, or Firm*—Shefte, Pinckney & Sawyer

[57] ABSTRACT

A transport system of the type having a plurality of tube support members for independent transport of yarn packages to and between locations on a textile machine or machines can readily accommodate tube support members supporting different kinds and sizes of yarn packages due to novel constructions of the tube support members in accordance with the present invention. Each tube support member includes a base component compatibly dimensioned with respect to the guiding and tube support driving components of the transport system, a post component for support of a yarn package thereon, and a bumper component for protecting a supported yarn package against undesirable collisions and other impacts with other yarn packages or objects. In several variations of the tube support member, the bumper component extends radially outward beyond the base component as well as the yarn package itself so that the bumper component contacts tube support members or other objects first to thereby prevent collision of the yarn package with the tube support members or other objects. Several variations of the tube support member are particularly suited for supporting yarn packages of the type having a frusto-conical shape such as, for example, so-called cross-wound packages, and the bumper components of such tube support members are structured to protect such yarn packages even where the maximum diameter of the yarn package exceeds the diameter of the base component of the tube support member.

15 Claims, 3 Drawing Sheets

SYSTEM FOR INDEPENDENTLY TRANSPORTING DIFFERENTLY SIZED TEXTILE PACKAGES ON INDEPENDENT TUBE SUPPORT MEMBERS HAVING IDENTICAL BASE COMPONENTS

BACKGROUND OF THE INVENTION

The present invention relates to a system for transporting textile packages on individual tube support members.

Transport systems are known in the textile machine art for independently transporting textile packages such as, for example, packages comprised of a body of yarn built on a tube, to and between locations on a textile machine or textile machines. One transport system of this type relies upon a plurality of tube support members, each having a cylindrical base component and a post co-axially mounted on the base component for receiving the yarn package tube inserted thereover. The tube support members each individually support a tube having no yarn, or a partial or full yarn package built thereon, for transport of the tube or yarn package independent of the tubes and other yarn packages to and between the yarn package handling locations of the textile machine arrangement. The cylindrical base components of the tube support members are of identical diameter, and one common approach to guiding, stopping, and organizing such tube support members in the transport system is to provide guide elements, stop elements, and the like positioned at the same vertical level as the cylindrical base component of the tube support members to thereby respectively guide, stop, or otherwise engage the tube support members.

The cylindrical base portion of the tube support members, in addition to providing a common dimensional reference for the layout of the guiding, stopping, and other handling components, provides protection for the yarn packages supported thereon from undesirable contact with other yarn packages or other objects This protective function is accomplished by dimensioning the cylindrical base component of &:he tube support member with a greater diameter than the maximum diameter of the yarn package supported thereon. Consequently, as the tube support member independently transports its associated yarn package and is thereby moved in the vicinity of other yarn packages supported on tube support members, as well as elements of the textile machine adjacent the travel path of the yarn package, the cylindrical base component of the tube support members is the first portion of the tube support member which is initially contacted by the other tube support members or other objects. In this manner, direct contact between the yarn package supported on the tube support member and, for example, other yarn packages or structures on the textile machine is avoided.

However, in certain textile operations, the type of textile package which is to be transported has a diameter significantly greater than other types of yarn packages. For example, a so-called cross-wound package typically has a diameter relatively much greater than a typical so-called bobbin. The cross-wound package typically has a frusto-conical shape with the bottom of the package being of a larger diameter than the top of the package. In German Patent Document DE-OS 34 16 387, a transport system is disclosed for transporting cross-wound packages. However, while several known transport systems are capable of transporting bobbin-type yarn packages independently of one another on tube support members and, further, several known transport systems are operable to transport cross-wound packages, the need still exists for a transport system which facilitates the transport of different types of yarn packages about a textile machine without significant changeover or re-tooling requirements to ready the transport system for transporting a different type of yarn package than the type of yarn package which the transport system currently transports.

SUMMARY OF THE INVENTION

By the present invention, a transport system for transporting packages of textile strand material is provided that is capable of transporting different types and sizes of yarn packages utilizing the same basic transport system with modified tube support members. Briefly described, the transport system of the present invention transports packages having a tube and a body of textile material wound on the tube to a predetermined radial extent. The tubes are mounted on a plurality of tube support members, with each tube support member and its associated package being movable as a single unit independently of the other tube support members and their associated packages. Each tube support member has a base component and a post component projecting therefrom, with the post component having an axis and the base component a predetermined circumferential extent. The post component is compatibly dimensioned with respect to the tube of a package for receiving the tube inserted thereover.

Each tube support member further includes a bumper component extending radially from the post component to an extent at least equal to the greater of the circumferential extent of the base component and the radial extent of the package being disposed, with the bumper component being disposed for engaging other tube support members or objects in the path of travel of the package to thereby prevent contact between the package and the other tube support members or other objects.

Further, means are provided for moving the tube support members to and between locations on at least one textile machine Preferably, the base component has a circular periphery and the bumper component has a circumferential surface with a radius at least equal to the greater of the radius of the base component measured at its circumference and the radial extent of the package, with the circumferential surface of the bumper component extending annularly with respect to the axis of the post component to form an annular wall. Also, preferably, the base component includes a disk with the annular wall extending from the circumference of the disk. The disk is co-axially mounted to its post component and each tube support member includes means for releasably mounting the post component on the base component. In one form of the invention, the tube support member includes a plurality of radially extending spokes with outward ends connected to the annular wall for co-axial support of the annular wall with respect to the axis of the post component with the openings between the spokes permitting air circulation therethrough.

Means may be provided for mounting the bumper component of each tube support member at a predetermined axial location on its post component for support of the package on the bumper component.

In another form of the invention, means are provided for rotatably supporting the post component on the base component for relative rotation, with the bumper component co-axially mounted to the post component for common rotation. In this embodiment, means are provided for frictionally engaging the extent of the bumper component for driving rotation of the bumper and post components about the axis. Alternatively, means can be provided for frictionally engaging the post component to effect driving rotation of the post component relative to the base component. In this embodiment, the post component may have a concave end accessible through the base component and the means for frictionally engaging the post component includes a drive member having a convex surface compatibly dimensioned with respect to the concavely-shaped end of the post component for engagement therewith to drivingly rotate the post component.

The invention has particular application where the radial extent of the package is greater than the radial extent of the base component and the bumper component then extends from the axis a distance greater than the respective radial extent of the package.

In the preferred embodiment, the transport system also transports packages having a shape that is compatible with tube support members that do not require modification according to the present invention. Thus, the system is applicable to transport packages of a type or size that normally fit the tube support member without modification and transport as well, in a combined operation, packages of oversize or different shape utilizing the modifications described above.

DESCRIPTION OF THE PREFERRED EMBODIMENT

Figure 1:
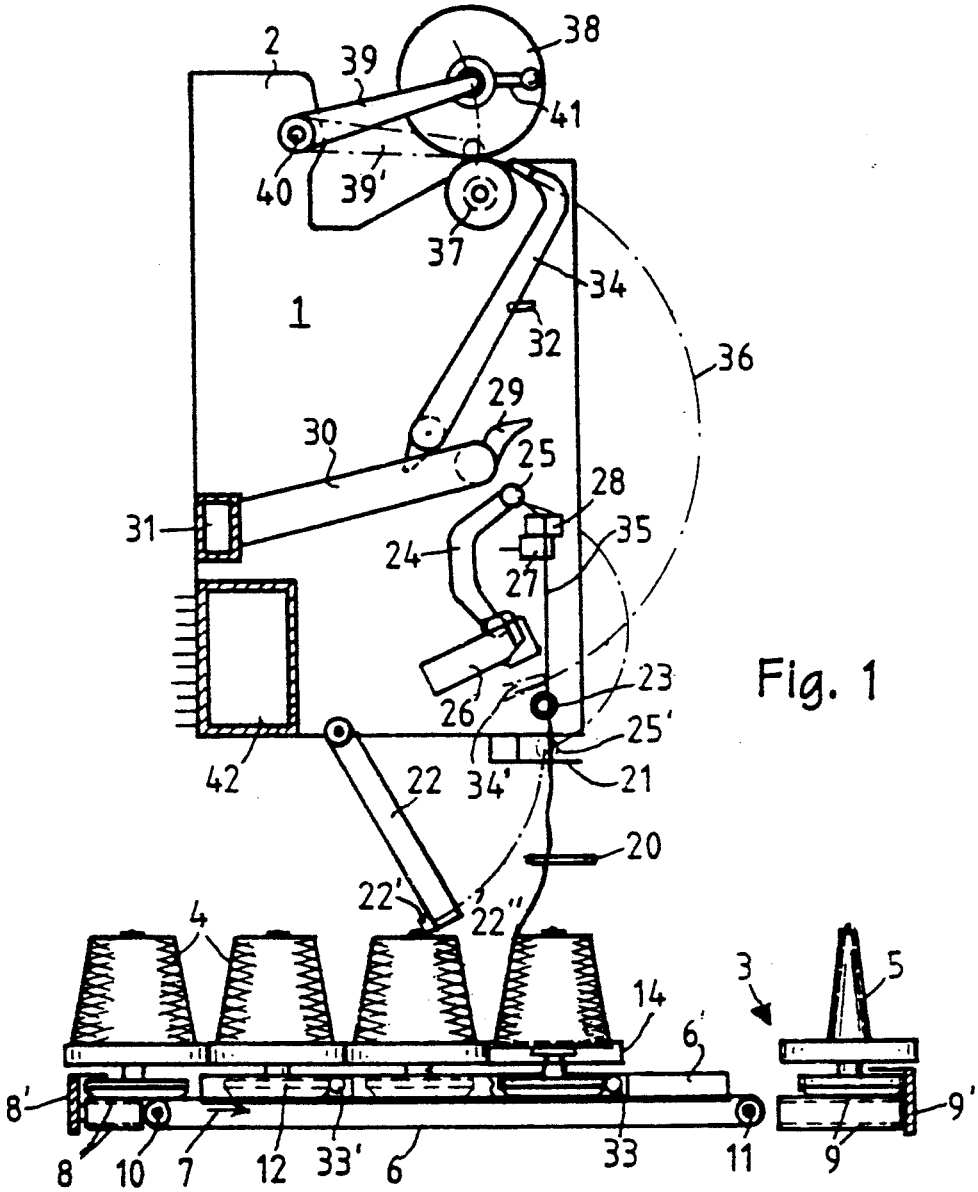
FIG. 1 is a schematic side elevational view of one winding station of a textile winding machine, showing a portion of one embodiment of the transport system of the present invention for transporting cross-wound-type yarn packages to and from the one winding station.

In FIG. 1, the preferred embodiment of the transport system of the present invention is illustrated. The transport system is operable to individually transport textile strand packages or tubes of the type on which textile strand material is built to and between locations for handling the packages or tubes being transported. For example, as exemplarily illustrated in FIG. 1, the transport system is operable to transport a plurality of cross-wound yarn packages 4 to and from locations on a textile winding machine such as, for example, to and from a winding unit 1 of the textile winding machine at which yarn is unwound from the cross-wound packages.

Each cross-wound package 4 comprises a tube 5 having a body of yarn built thereon, the body of yarn being formed in a frusto-conical shape and having a larger diameter at its bottom than at its top. The tube 5 of each cross-wound package 4 is of a frusto-conical shape tapering in the same direction as the body of yarn built on the tube. Each cross-wound package 4 is individually supported on a tube support member 3 of the transport system for movement of the cross-wound package independently of the other cross-wound packages. The tube support members 3 are transported to and between locations on the textile winding machine by a plurality of driven endless belt assemblies in cooperation with guide assemblies for guiding of the tube support members. For example, as seen in FIG. 1, a delivery endless belt assembly 8, which includes an endless belt trained around a drive roller and a guide roller (not shown) cooperates with a delivery guide assembly 8' which guides the tube support members 3 during their transport by the endless belt of the delivery endless belt assembly 8.

A cross path endless belt assembly 6 includes an endless belt extending transversely to the direction of travel of the endless belt of the delivery endless belt assembly 8 through the winding station 1. The upstream end of the endless belt of the cross path endless belt assembly 6 is disposed adjacent the delivery endless belt assembly 8 for effecting transfer of the tube support members 3 on the delivery endless belt assembly 8 onto the cross path endless belt for subsequent transport of the cross-wound packages 4 on the tube support members 3 to an unwinding location at the winding station 1. The downstream end of the cross path endless belt is disposed adjacent a discharge endless belt assembly 9, described in more detail shortly, for transporting the tube support members 3 to a further handling location (not shown after unwinding of the yarn from the cross-wound packages 4 supported on the tube support members.

The cross path endless belt is trained around a guide roller 10 and a drive roller 11, which is operatively connected to a conventional drive motor (not shown) for driving operation of the cross path endless belt in the direction indicated by the arrow 7 in FIG. I.

Figure 2:
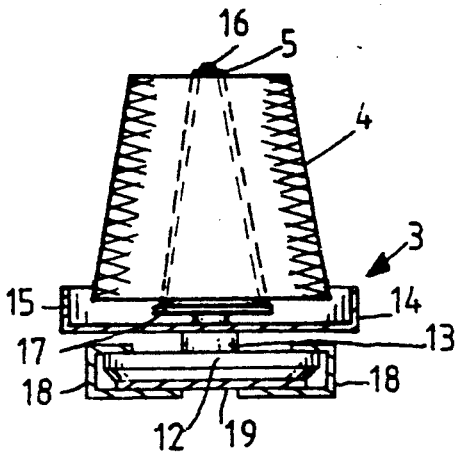
FIG. 2 is a front elevational view, in partial vertical section, of the one embodiment of the transport system shown in FIG. I and showing one variation of the tube support members of the transport system.

As seen in FIG. 2, in one variation of the tube support member 3, the tube support member 3 includes a base component 12 having a predetermined circumferential extent, a post component 16 projecting therefrom along an axis, and a bumper component 14 extending radially from the post component at an axial spacing from the base component. The post component 16 includes a frusto-conical support portion compatibly configured with respect to the frusto-conical tube on which the body of yarn of a cross-wound package 4 is built and a collar 17 for receiving the bottom of a tube of a cross-wound package 4 thereon to support the cross-wound package on the tube support member 3.

The bumper component 14 extends radially from the post component in the form of a disk fixedly co-axially mounted by a neck portion 13 to the base component 12. The disk has an axially extending annular or circumferential wall 15 forming a recess in which the bottom portion of the body of yarn of the cross-wound package 4 is received when the cross-wound package is supported on the post component 16 with the collar 17 engaging and supporting the bottom of the cross-wound package. The circumferential wall 15 is at a radial spacing from the axis of the base component 12 to an extent at least equal to the greater of the extent of the base component 12 and the extent of the bottom of the cross-wound package 14.

As seen in FIG. 2, the guide assemblies of the transport system for guiding the tube support members 3 are preferably dimensioned relative to the base component 12 of a tube support member 3 such that the tube support members 3 can be guided by engagement between their base components 12 and the guide assemblies. For example, as seen in FIG. 2, a guide assembly has a conventional configuration comprised of a pair of oppositely facing flange portions 18, each having an elongate leg, a relatively shorter leg, and an interconnecting segment interconnecting the legs. The elongate legs of the flange portions 18 are co-planar and uniformly spaced from one another and the elongate legs support an endless belt such as, for example, an endless belt 19, during travel of the endless belt along its top run. The interconnecting segments of the flange portion 18 extend vertically transversely to the elongate legs and are at a spacing from one another slightly larger than the diameter of the base component 12 of a tube support member 3. The relatively shorter legs of the flange portions 18 extend inwardly for cooperating with the elongate legs to limit the movement of the tube support members 3 in a direction parallel to the axis of the base component thereof.

The bumper component 14 is disposed with a sufficient extent for engaging the bumper components of other tube support members 3 or other objects to thereby prevent contact of the cross-wound package supported on the tube support member with other packages or other tube support members or other objects. The circumferential wall 15 extends in complete encircling relation relative to the cross-wound package 4 supported on the respective tube support member 3 so that the circumferential wall 15 contacts the circumferential wall 15 on the other tube support members 3, or other objects supported at the same axial position as the circumferential wall 15, without any contact between the crosswound package 4 and the contacted circumferential wall or other object.

To facilitate the orderly positioning of the tube support members 3 at the unwinding location for unwinding of yarn from the cross wound packages 4, the transport system includes a stop assembly having a selectively extendable and retractable stopper 33. The stopper 33 is selectively extendable transverse to the direction of travel of the tube support members 3 along the cross path to engage a tube support member 3 and maintain the tube support member at the unwinding location.

In correspondence with the unwinding of the yarn of the cross wound package 4 supported on the respective engaged tube support member 3, the stopper 33 is retracted to permit further transport of the respective tube support member downstream beyond the unwinding location for subsequent transport by the discharge endless belt assembly 9. As the next following tube support member 3 advances into the unwinding location, the stopper 33 is again extended to engage this next following tube support member and maintain it at the unwinding location.

The operation of the preferred embodiment to the transport system to transport the cross-wound packages 4 to and from the winding station 1 will now be described with reference to FIG. 1. The transport endless belt assembly 8 transports the tube support members 3, each supporting a cross-wound package 4, from a delivery location (not shown) and the bottom surfaces of the base components 12 of the tube support members 3 are maintained by the delivery guide assembly 8' on the delivery endless belt such that a portion of the tube support member extends laterally beyond one edge of the delivery endless belt.

The cross path delivery belt, which may be continuously operated or, alternatively, intermittently operated, engages the portion of each tube support member 3 extending laterally beyond the delivery belt and pulls the engaged tube support member fully onto its top run for subsequent advancing movement into the unwinding location. The length of the top run of the cross path endless belt is selected such that, when a single tube support member 3 is positioned at the unwinding position and two other tube support members 3 are supported on the cross path endless belt awaiting subsequent delivery to the unwinding location, the cross path endless belt has no further capacity to accept additional tube support members, whereby other tube support members 3 being transported by the delivery endless belt are transported to other winding stations of the textile winding machine.

The winding station 1 includes a suction assembly for engaging a yarn end of a cross-wound package 4 to transfer the engaged yarn end to a pre-splicing position 25'. The suction assembly includes a suction arm 22 pivotally mounted to a frame 2 of the winding unit and having a suction end 22' for applying suction to a yarn end of the respective cross-wound package 4 supported on the tube support member 3 which is the next tube support member to be transferred to the unwinding location. The suction arm 22 is pivotable to move its suction opening 22' along an arcuate travel path 22'' extending from a tube end engagement location at which the suction end 22' engages a yarn end on top of the respective cross-wound package 4 in the pre-splicing position 25'. Due to the fact that the suction opening 22' engages a yarn end of the respective cross-wound package 4 which is next to be advanced to the unwinding location, the preparation of the yarn end of each cross-wound package for splicing with a yarn end from the finish package 38 can be initiated prior to the advancing movement of the respective cross-wound package 4 into the unwinding location.

The winding unit 1 includes a supply package suction assembly for moving a yarn end held by the suction opening 22' at the pre-splicing location 25' along an arcuate travel path. The supply package suction assembly includes a suction arm 24 having a suction opening 25 for engaging the yarn end, the suction arm 24 being pivotally mounted to the frame 2.

The yarn end which has been engaged by the suction opening 25 such as, for example, a yarn end 35, is received in a yarn brake 23, a yarn cleaner 27, and a yarn cutting and clamping device 28 in correspondence with the completion of travel of the suction opening 25 along the arcuate travel path. The winding unit I also includes a finish package suction assembly having a suction arm 34 pivotally mounted to the frame 2 for pivoting of a suction opening of the suction arm along an arcuate travel path 36 between a position adjacent the finish package 38 at which the suction arm 34 applies suction to engage a yarn end of the finish package and an end position 34'. The end position 34' is selected such that the engaged finish package yarn end is disposed in the yarn cleaner 27 and the yarn cutting and clamping device 28 in correspondence with the movement of the suction opening of the suction arm 34 into the end position 34'. Once a yarn end from the respective cross-wound package 4 to be unwound and a finish package yarn end have both been disposed by the respective suction assemblies in the yarn cleaner 27 and the yarn cutting and clamping device 28, a conventional yarn end splicing device 26 is moved by a conventional movement device (not shown) to a splicing position in which it splices the two yarn ends together.

A suction nozzle 29 is pivotally mounted to the free end of a suction arm 30 for applying a suction adjacent the yarn cutting and clamping device 28 to engage and carry away cut yarn ends. The suction arm 30 is communicated with a common suction conduit 31 extending along the winding units of the textile winding machine and communicated with the suction arms therewith.

In correspondence with splicing of the yarn end of a respective cross-wound package 4 with a yarn end from the finish package 38, the winding operation of the finish package 38 is renewed. The finish package 38 is rotatably supported on an arm 39 which is pivotally mounted on a shaft 40 to the frame 2. Prior to the winding of any yarn on the finish package 38, the empty tube of the finish package is supported generally at the position 39' in which the empty tube is in rolling contact with a traversing winding drum 37. As the diameter of the finish package increases as the yarn is wound thereon, the arm 39 is pivoted about the shaft 40 in a counterclockwise manner. Upon completion of the winding of the finish package 38, an opening handle 41 can be manipulated to release the now completed finish package 38 from its supported position on the arm 39.

During winding of the yarn from the respective cross-wound package 4 at the unwinding location, the yarn travels through a conventional balloon controller 20, a conventional yarn guide 21, the yarn brake 23, the yarn cleaner 27, the yarn cutting and clamping device 28, a second yarn guide 32, and thereafter onto the traversing winding drum 37 for winding of the yarn on a finish package 38. A control unit 42 is preferably provided and operatively connected to appropriate components of the winding unit 1 to control the winding operation in a coordinated manner.

The selection of the diameter of the circumferential wall 15 of the bumper component 14, in addition to taking into consideration the maximum diameter of the cross-wound package 4 to be supported on the respective tube support member as well as the diameter of the cylindrical portion of the base component 12 of the tube support member, can additionally take into consideration the desirability of constructing the circumferential walls of a diameter such that the bumper component 14 of the respective tube support member 3 supported at the upstream end of the cross path endless belt extends sufficiently laterally toward the delivery endless belt to prevent an oncoming tube support member 3 from being drawn off of the delivery endless belt onto the cross path endless belt. Alternatively, a second stop assembly can be provided having a stopper 33' which is selectively extendable to a blocking position transverse to the travel direction of the tube support members 3 along the cross path endless belt 4 blocking the travel therepast of the respective tube support member 3 at the upstream position of the cross path endless belt. The stopper 33' is retractable to permit travel therepast of the endmost tube support member 3 in correspondence with the advancing movement of the tube support members along the cross path. In this regard, the retracting movement of the stopper 33' is coordinated with the retracting movement of the stopper 33 such that the retraction of the stopper 33' is delayed until the stopper 33 has been retracted so that the suction opening 22' can be pivoted to its receipt position for engaging a yarn end of the respective cross-wound package 4 being advanced into the position adjacent the unloading position. The stoppers 33,33' are preferably operatively connected to the control unit 42 for control thereby.

Figure 3:
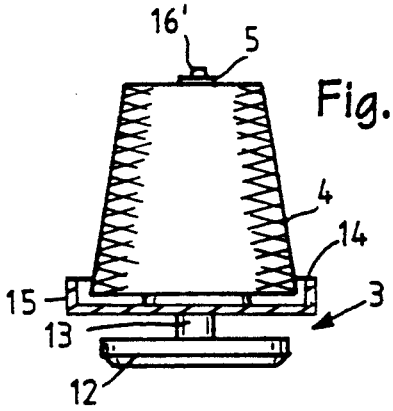
FIG. 3 is a front elevational view of another variation of a tube support member and the package supported thereon.

In FIG. 3, another variation of the tube support member 3 of the transport system is illustrated. This variation is identical to the variation of the tube support member described with respect to FIG. 2, except that the variation in FIG. 3 omits the collar 17 on which the bottom of the tube 5 of the cross-wound package 4 is supported. Accordingly, the weight of the cross-wound package 4 is fully supported by the conical portion of the post component 16. This variation of the tube support member 3, in contrast to the variation described with respect to FIG. 2, permits the cross-wound package 4 to be supported at a smaller axial spacing from the base component 12, thereby advantageously disposing the center of gravity of the cross-wound package correspondingly closer to the base component 12. This advantageously reduces the risk of undesired tipping of the cross-wound package 4 during transport.

Figure 4:
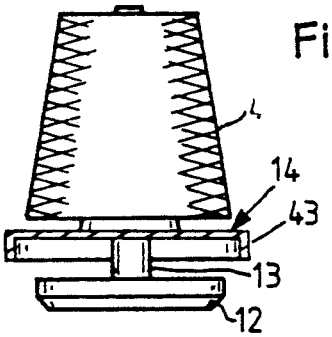
FIG. 4 is a front elevational view of a further variation of a tube support member.

In FIG. 4, a further a variation of tube support member of the transport system of the present invention is illustrated. The tube support member in this variation comprises a base component 12 identically configured as the base component of the variation of the tube support member described with respect to FIG. 2, a post component for supporting a cross-wound package 4 thereon, and a bumper component 15 co-axially fixedly mounted by a column 13 to the base component 12. The bumper component 14 includes a disk portion and a circumferential wall 43 extending axially from the circumference of the disk portion in the axial direction toward the base component 12. Since the circumferential wall 43 extends downwardly from the disk portion of the bumper component 14, the tube support members constructed in accordance with this variation contact each other at a relatively small spacing above the base components 12, thereby advantageously reducing the risk that a tube support member will undesirably tilt as a result of contact with another tube support member.

Figure 5:
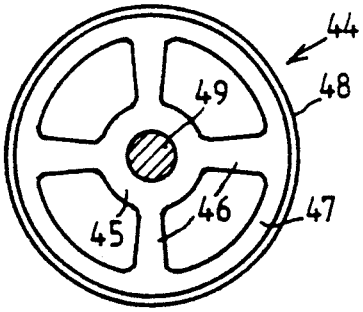
FIG. 5 is a top plan view, in horizontal section, of a portion of an additional variation of a tube support member of the transport system.

In FIG. 5, an additional variation of the tube support member of the transport system of the present invention is illustrated. In this variation, the tube support member includes a post component, which is preferably identical to any one of the post components described with respect to FIGS. 1–4, a bumper component 44, and a base component: (not shown) which is identical to the base component described with respect to FIGS. 1–4. The bumper component 44 includes a hub portion 45 and a plurality of spokes 46 projecting radially from the hub portion 45 at uniform angular spacings from one another. A circular ring portion 47 is mounted to the radially outer ends of the spokes 46 and the circular ring portion supports a circumferential wall 48 which can extend axially in the direction from the base component toward the post component, such as the circumferential wall 15 described with respect to the variation illustrated in FIG. 3 or, alternatively, in the axial direction from the post component toward the base component, such as the circumferential wall 43 described with respect to the variation illustrated in FIG. 4.

The variation of the tube support member illustrated in FIG. 5 advantageously permits circulation of air upwardly through the spaces between the spokes 46 and this air circulation phenomena reduces the tendency of dust, debris, and the like to collect on the relatively extensive horizontal surfaces of the tube support member.

Figure 6:
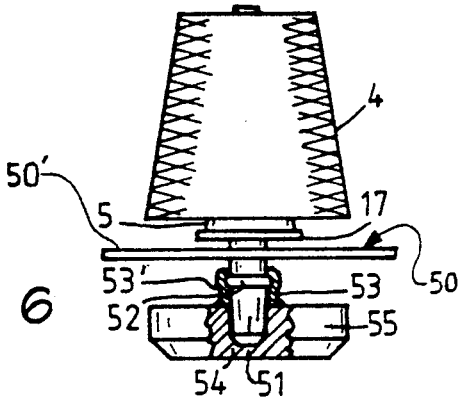
FIG. 6 is a front elevational view, in partial vertical section, of a further additional variation of a tube support member for one of the embodiments of the transport system and showing a yarn package supported on the tube support members.

In FIG. 6, a further additional variation of the tube support member of the transport system of the present invention is illustrated. The tube support member includes a post component having a collar 17 for supporting the bottom of the tube 5 of a cross-wound package 4, a bumper component 50, and a base component 55. The bumper component 50 comprises a disk of uniform thickness having a circumferential surface 50', which preferably has a sufficient axial extent to insure that the tube support members of this variation contact one another on their circumferential surfaces 50' instead of overlapping contact between the bumper components 50.

The bumper component 50 is mounted on a column 51 which includes a collar 52. A neck portion 53 having a hollow interior is mounted on the base component 55 and is provided with a plurality of angularly-spaced, axially-extending grooves (not shown) for permitting radially outward expansion of the neck portion upon insertion therein of the column 51, which has a diameter slightly larger than the diameter of the hollow interior of the neck portion. An annular recess 53' is formed in the neck portion for receiving therein the collar 52 of the column 51 to thereby maintain the column 51 in an affixed axial position relative to the base component 55. The base component 55 includes a bore 54 for receiving the lower portion of the column 51.

The variation of the tube support member illustrated in FIG. 6 offers interchangeability of the types of post components and their associated bumper components in that the column 51 can be readily inserted into and withdrawn from its seated disposition in the neck portion 53 and the bore 54 of the base component 55.

Figure 7:
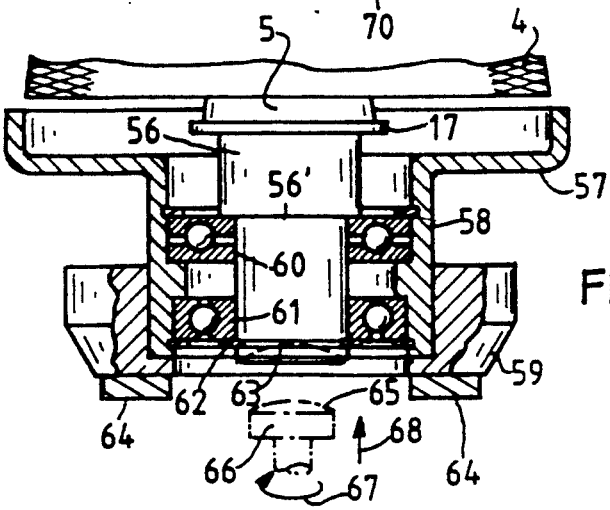
FIG. 7 is an enlarged front elevational view, in partial vertical section, of a portion of yet another additional variation of a tube support member.

In FIG. 7, another additional variation of the tube support member of the transport system of the present invention is illustrated. The tube support member includes a post component having a collar 17 for supporting the bottom of the tube 5 of a cross-wound package 4, a bumper component 57, and a base component 59. The post component includes a first shaft 56 extending from the collar 17 axially in the direction of the base component 59 and a second shaft 56' of smaller diameter than the first shaft 56 and co-axially mounted thereto. The bumper component 57 includes a neck portion 58 having a hollow interior for receiving an axial bearing assembly 60 and a radial bearing assembly 62 therein which rotatably support the post component.

One portion of an axial bearing assembly 60 is mounted to the second shaft 56' and forms, with another complementary portion of the axial bearing assembly spaced axially therefrom, a bearing race for a plurality of ball bearings. A portion of a radial bearing assembly 61 is mounted to the second shaft 56' at an axial spacing below the axial bearing assembly 60 and cooperates with another complementary portion of the radial bearing assembly spaced radially therefrom to form therebetween a bearing race in which a plurality of ball bearings are disposed The axial bearing assembly 60 and the radial bearing assembly 61 are each secured by conventional securement means (not shown) against axial movement relative to the neck portion 58 of the bumper component 57.

The axial bearing assembly 60 and the radial bearing assembly 61 rotatably support the second shaft 56' within the neck portion 58 of the bumper component 57 for axial rotation of the post component relative to the bumper component. A locking ring 62 is disposed axially below the radial bearing assembly 61 and is fixedly secured to the second shaft 56' for limiting axial movement of the post component in the axial direction from the base component 59 toward the cross-wound package 4.

The second shaft 56' extends through the base component 59 with an end accessible from below the base component and having a lower surface 63 of a concave or conical shape compatibly configured with the respective convex or conical shape of a frictional engaging surface 65 of a drive member 66. The drive member 66 is operatively connected to a conventional drive motor (not shown) and is axially movable in the direction indicated by the arrow 68 by a conventional axial displacement mechanism (not shown) to selectively bring the frictional engaging surface 65 into frictional engagement with the lower surface 63 of the second shaft 56' for driving rotation of the post component in the direction of rotation 67 of the drive member 66. To permit access of the drive member 66 to the post component, &:he transport system may include, for example, a conveyor arrangement comprising a pair of laterally-spaced driven belts. For example, as seen in FIG. 7, a pair of laterally spaced driven belts 64 define an opening therebetween through which the driven member 66 can move into and out of engagement with the post component.

The present invention also contemplates, in connection with the variation of the tube support member shown in FIG. 7, that the frictional driving arrangement of the post component can alternatively be constructed as a gear driving arrangement in which the lower surface 63 is provided with a gear ring or the like for meshing engagement by a drive gear mounted on top of the drive member 66 in lieu of the frictional engaging surface 65. Such a gear driving arrangement would advantageously reduce the magnitude of the axial force exerted on the post component by the drive member 66 although the frictional drive arrangement exemplarily illustrated in FIG. 6 should not normally lead to a situation in which the axial force of the drive member 66 on the post component exceeds the cumulative weight of the cross-wound package 4 and the post component.

Figure 8:
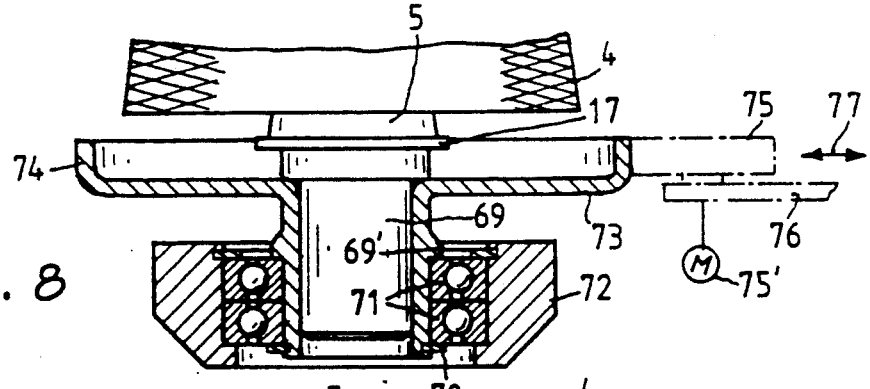
FIG. 8 is an enlarged front elevational view, in partial vertical section, of a portion of yet another further variation of a tube support member for use in one of the embodiments of the transport system of the present invention.

In FIG. 8, another further variation of the tube support member of the transport system of the present invention is illustrated. The tube support member includes a post component having a collar 17 for support of the tube 5 of a cross-wound package 4 thereon, a bumper component 73, and base component 72. The bumper component 73 includes a hollow neck portion in which a first shaft 69 of the post component is fixedly mounted. One portion each of a pair of axial bearing assemblies 71 are mounted to the neck portion of the bumper component for cooperating with a pair of complementary portions of the axial bearing assemblies to form a pair of bearing races, each for supporting a plurality of ball bearings. The complementary portions of the axial bearing assembly 71 are fixedly mounted to the base component 72 and are secured against axial movement therein. A locking ring 70 is fixedly mounted to the lower axial end of the neck portion of the bumper component 73 for mounting the bumper component 7 and the post component against axial movement relative to the base component 72. A shoulder 69' formed on the base component 72 secures the axial bearing assembly 71, in cooperation with a complementary lower shoulder, in the base component 72.

The bumper component 73 includes a circumferential wall 74. A drive roller 70 is mounted on a pivotally mounted carrier 76 and is operatively connected to a drive motor 75' for rotation of the drive roller. As shown by the double arrow 77 in FIG. 8, the carrier 76 is pivotally mounted to the textile machine frame for pivoting toward and away from a tube support member to selectively move the drive roller 75 into and out of frictional engagement with the circumferential wall 74 of the bumper 73. The drive roller 75, through frictional engagement of the circumferential wall 74, drivingly rotates the post component and the bumper component 73 as an integral unit relative to the base component 72 for winding or unwinding rotation of the cross-wound package 4 supported on the post component during, for example, an unwinding operation in which yarn is unwound from the cross-wound package at the winding unit I.

Figure 9:
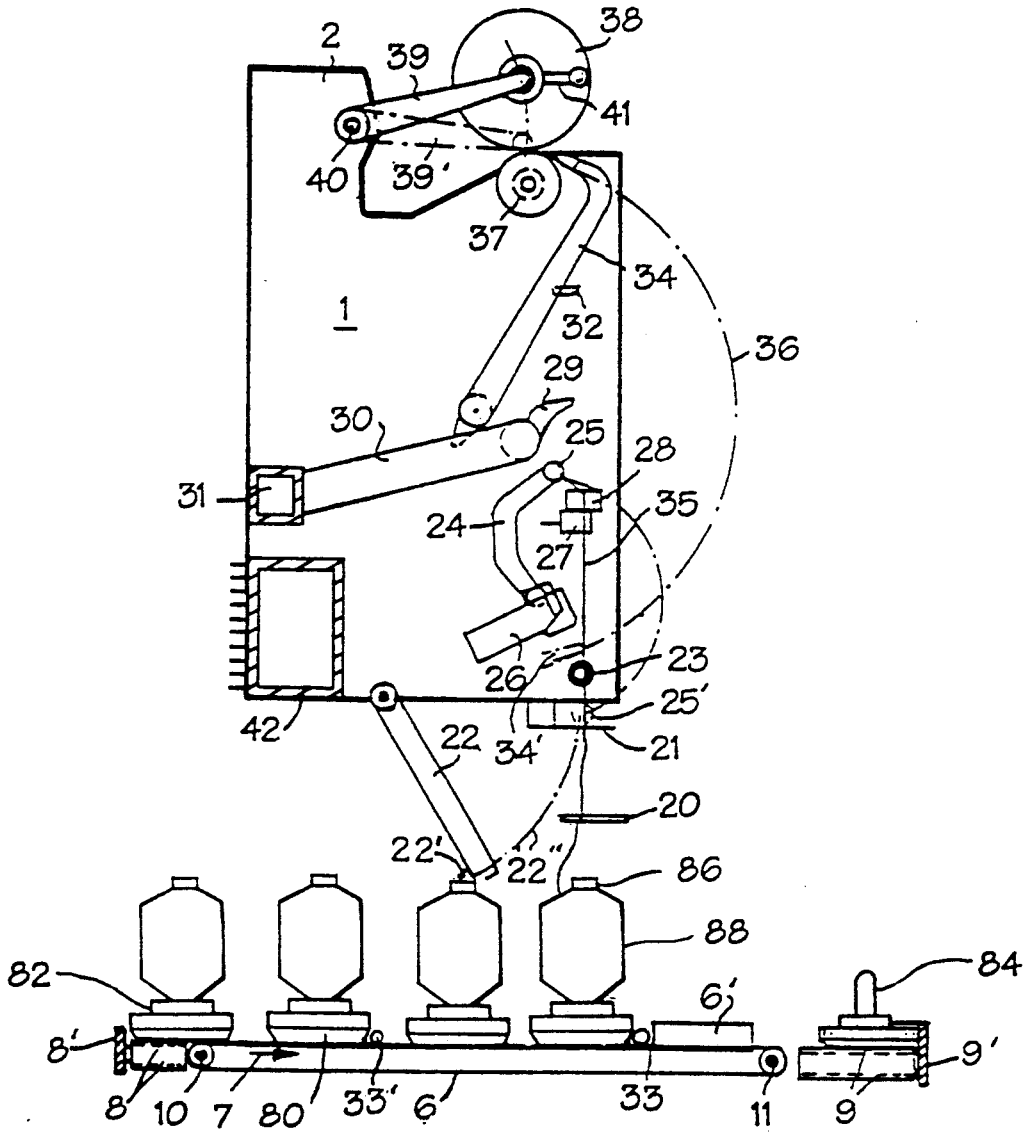
FIG. 9 is a side elevational view of the winding station shown in FIG. 1 and showing a plurality of tube support members for transporting a plurality of bobbin-type yarn packages.

As seen in FIG. 9, the transport system is capable of handling tube support members of conventional configurations in addition to the variations of the tube support members described with respect to FIGS. 1–8. For example, as seen in FIG. 9, the transport system is also operable to handle a conventional tube support member having a base component 80, a circular neck component 82 co-axially mounted on the base component 80, and a post component 84 of smaller diameter than the neck component 82 co-axially fixedly mounted on the neck component. The post component 84, which is circular in shape, has a diameter selected in correspondence with the inside diameter of a tube 86 on which a yarn package 88 is built for relatively snug receipt of the tube on the post component. The neck component 82 supports the bottom of the tube 86 thereon. The yarn package 88 supported by the tube support member illustrated in FIG. 9 is a conventional yarn package of the type, for example, having a body of yarn comprising a cylindrical portion and two tapering end portions with the cylindrical portion forming the maximum diameter of the yarn package.

Since the base component 80 of the variation of the tube support member illustrated in FIG. 9 is, as measured at its maximum circumferential extent, of the same diameter as the variations of the tube support members illustrated in FIGS. 1–8, the tube support member can be readily guided and otherwise manipulated by the guiding and drive components of the transport system. For example, the base component 80 of the tube support member is guided within the opposed flanges 18 in the same manner as the base component 12 of the variation of the tube support member illustrated in FIG. 2 is guided by the opposed guide flanges. In the conventional variation of the tube support member illustrated in FIG. 9, the base component 80 operates to initially contact other tube support members or other objects to thereby prevent collisions or other damaging impacts to the yarn package 88 supported on the tube support member, which has a maximum diameter less than the diameter of the base component 80. Thus, the tube support members illustrated in FIG. 9 do not require or include a separate bumper component extending radially beyond the maximum diameter of the yarn package support on the tube support member since the base component itself acts as a bumper component.

In the embodiments described, the packages used with the tube support members with bumper components are frusto-conical cross-wound packages, but the invention is applicable as well to oversize cylindrical packages and other configurations where the size is sufficient that the radial extent of the package is greater than that of the base component such that a bumper component is necessary to protect the yarn package from contact with other packages, support members, or other objects.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A transport system for transporting packages of textile strand material to and between locations on at least one textile machine, each package including a tube and a body of textile material wound on the tube to a predetermined radial extent, the transport system comprising:

a plurality of tube support members for individually supporting the packages thereon, each tube support member and its associated package being movable as a single unit independently of the other tube support members and their associated packages and each tube support member including a base component and a post component projecting therefrom, said post component having an axis and said base component having a predetermined circumferential extent no greater than the radial extent of the package supported thereon, said post component being compatibly dimensioned with respect to the tube of a package for receiving the tube inserted thereover, and a bumper component extending radially from the post component to an extent at least equal to the radial extent of the package and disposed for engaging other tube support members or objects in the path of travel of the package to thereby prevent contact between the package and other packages or other tube support members or other objects; and means for moving the tube support members to and between locations on the at least one textile machine.

2. A transport system according to claim 1 wherein the base component has a circular periphery and said bumper component includes a circumferential surface having a radius at least equal to the greater of the radius of the base component measured at its circumference and the radial extent of the package.

3. A transport system according to claim 1 wherein the bumper component includes a circumferential surface which extends annularly with respect to the axis of the post component to form an annular wall.

4. A transport system according to claim 3 wherein the base component of each tube support member includes a disk and said annular wall extends annularly from the circumference of the disk 5. A transport system according to claim I and further comprising means for mounting the bumper component of each tube support member at a predetermined axial location on its post component for support of the package on the bumper component.

6. A transport system according to claim I wherein the radial extent of the package is greater than the radial extent of the base component of the respective tube support member on which the package is supported and the bumper component extends from the axis a distance greater than the respective radial extent of the package mounted on the tube support member.

7. A transport system according to claim 1 wherein the package is formed with the textile material wound in a generally frusto-conical shape with one end being of a larger diameter than the other end and being wound to said predetermined radial extent.

8. A transport system according to claim I and further comprising another plurality of tube support members, the tube support members of the another plurality of tube support members individually supporting thereon another size of package each of which includes a tube and a body of textile strand material wound on the tube, and each tube support member of the another plurality of tube support members including a base component having an axis and a circumference greater than &:he maximum diameter of a package of the another size of packages, and a post component co-axially mounted on the base component for support of a package of the another size of packages on the tube support member, the diameter of the base component of each tube support member of the another plurality of tube support members being substantially equal to the diameter of the base component of the first-mentioned plurality of tube support members and the means for moving the tube support members to and between locations on the at least one textile machine includes guide means compatibly dimensioned with respect to the diameter of a base component of a tube support member for common guiding of the first-mentioned plurality of tube support members and the another plurality of tube support members.

9. A transport system according to claim I and further comprising another plurality of tube support members, the tube support members of the another plurality of tube support members individually supporting thereon another type of package each of which includes a tube and a body of textile strand material wound on the tube with a cylindrical portion, the cylindrical portion of the body of textile strand material of each package forming the maximum diameter of the package, and each tube support member of the another plurality of tube support members including a base component having an axis and a circumference greater than the maximum diameter of a package of the another type of packages, and a post component co-axially mounted on the base component for support of a package of the another type of packages on the tube support member, the diameter of the base component of each tube support member of the another plurality of tube support members being substantially equal to the diameter of the base component of the first-mentioned plurality of tube support members and the means for moving the tube support members to and between locations on the at least one textile machine includes guide means compatibly dimensioned with respect to the diameter of a base component of a tube support member for common guiding of the first-mentioned plurality of tube support members and the another plurality of tube support members.

10. A transport system according to claim 4 wherein the disk of each tube support member is co-axially mounted to its post component and each tube support member includes means for releasably mounting its post component on its base component.

11. A transport system according to claim 3 wherein the base component of each tube support member includes a plurality of radially extending spokes, the radially outward end of each spoke being connected to the annular wall, and the spokes supporting the annular wall of the tube support member co-axial with the axis of the post component.

12. A transport system according to claim 1 wherein each tube support member includes means for rotatably supporting its post component on its base component for rotation of the post component relative to the base component.

13. A transport system according to claim 12 wherein the post component and the bumper component of each tube support member are co-axially mounted to one another for common rotation together and further comprising means for frictionally engaging the extent of the bumper component of each tube support member for driving rotation of the bumper component and the post component about the axis.

14. A transport system according to claim 12 and further comprising means for frictionally engaging the post component of each tube support member to effect driving rotation of the post component relative to the base component.

15. A transport system according to claim 14 wherein said post component of each tube support member has an end accessible through said base component, said end being concave, and the means for frictionally engaging the post component of each tube support member includes a drive member having a convex surface compatibly dimensioned with respect to the concavely shaped end of the post components for engagement therewith to drivingly rotate the post components.

* * * * *